US009687092B2

(12) United States Patent
Cabanes

(10) Patent No.: US 9,687,092 B2
(45) Date of Patent: Jun. 27, 2017

(54) PICTURE FRAME WALL HANGING AND LEVELING ASSEMBLY

(71) Applicant: Rick Cabanes, Manhattan Beach, CA (US)

(72) Inventor: Rick Cabanes, Manhattan Beach, CA (US)

( * ) Notice: Subject to any disclaimer, the term of this patent is extended or adjusted under 35 U.S.C. 154(b) by 0 days.

(21) Appl. No.: 15/175,015

(22) Filed: Jun. 6, 2016

(65) Prior Publication Data

US 2017/0007045 A1 Jan. 12, 2017

Related U.S. Application Data

(60) Provisional application No. 62/188,904, filed on Jul. 6, 2015.

(51) Int. Cl.
*A47G 1/24* (2006.01)
*A47G 1/16* (2006.01)

(52) U.S. Cl.
CPC ..... *A47G 1/1613* (2013.01)

(58) Field of Classification Search
USPC ..... 248/476
See application file for complete search history.

(56) References Cited

U.S. PATENT DOCUMENTS 2,299,443 A * 10/1942 Walmsley ..... A47G 1/1606 248/207
2,509,424 A * 5/1950 Denton ..... A47G 1/1613 248/495
2,530,892 A * 11/1950 Mayo ..... A47G 1/1606 248/224.7
2,635,840 A * 4/1953 Barry ..... A47G 1/1606 248/497
2,965,339 A * 12/1960 Denton ..... A47G 1/1613 248/495
3,051,427 A * 8/1962 Alvarez ..... A47G 1/1686 248/224.8
4,069,998 A * 1/1978 Rytting ..... A47G 1/1606 248/225.21
4,591,125 A * 5/1986 Bellehumeur ..... A47G 1/1606 248/476
4,611,780 A * 9/1986 Robertson ..... A47G 1/1613 248/477
4,883,247 A * 11/1989 Crandall ..... A47G 1/1613 248/489
5,303,895 A * 4/1994 Hart ..... A47G 1/168 248/475.1
6,719,260 B1 * 4/2004 Hart ..... A47G 1/168 248/466
7,891,124 B1 * 2/2011 Willis ..... A47G 1/1606 248/477
8,371,543 B2 * 2/2013 Schneider ..... F16M 13/02 248/224.8
9,186,001 B2 * 11/2015 Popkin ..... A47G 1/162

* cited by examiner

*Primary Examiner* — Monica Millner
(74) *Attorney, Agent, or Firm* — Hybrid Law Group P.C.

(57) ABSTRACT

A picture frame wall hanging and leveling assembly is described. It contains a frame plate having a tab extending downward from the frame plate and further having two or more screw holes for screwing the frame plate to the picture frame. The assembly further contains a wall mount having a horizontal slot along the length of the base plate that receives the tab of the frame plate and walls around the slot.

8 Claims, 6 Drawing Sheets

PICTURE FRAME WALL HANGING AND LEVELING ASSEMBLY

This application claims priority to U.S. Provisional Application Ser. No. 62/188,904, filed Jul. 6, 2015, the entirety of which is incorporated herein by reference.

BACKGROUND

This invention relates generally to the field of picture frame wall hanging assemblies and systems for hanging pictures and similar articles on a vertical wall or similar supporting surface.

Hanging pictures, paintings and other articles on walls has always been a difficult and cumbersome task that often requires trial and error. People often attempt to level a frame by eyeballing it or using a level device. This often requires many tries in order to obtain a good result. Another method is to have two people work at the task with one person holding the frame against the wall while the other determines if it is level. Then in addition to making sure the frame is level and plumb, the frame can look sloppy or unattractive if it is not resting tightly against the wall. This often happens when using conventional nails or screws that stick out too far from the wall pushing the picture or frame away from the wall. Finally, once initially leveled and fitted snuggly against the wall, the frame may eventually shift over time so that it no longer is level. Therefore, minor adjustments to the frame are constantly needed to keep it level.

Various solutions have been proposed to solve this problem, but none of them are adequate. For example, spirit levels are used to indicate whether an object is horizontal (level) and plumb (vertical). The problem is that once the frame is actually mounted, it may still not be level and plumb and there is no way to make firm and permanent adjustments that keep the frame level and plumb.

What is needed is a solution that allows quick and easy mounting of frames to walls that keep the frames level and plumb and can be adjusted if they are not initially level and plumb.

SUMMARY

In one embodiment, a picture frame hanging assembly is described. The picture frame hanging assembly has a frame plate having a tab extending downward from the frame plate and further having two or more screw holes for screwing the frame plate to the picture frame. The assembly further contains a wall mount having a horizontal slot along the length of the base plate that receives the tab of the frame plate and walls around the slot.

In another embodiment, a picture frame hanging assembly has a frame plate, a wall mount, and a leveling shelf. The frame plate has a tab extending downward from the frame plate and further has two or more screw holes for screwing the frame plate to the picture frame. The top of the wall mount forms a shelf that has two screw holes on opposite sides of the shelf, the screw holes being a distance from one another. The leveling shelf has a slot and two screw holes that are on opposite sides of the slot. The two screw holes of the leveling plate are at the distance from one another as the two screw holes of the wall mount. When assembled the tab of the frame plate is inserted into the slot of the leveling shelf and rests atop the leveling shelf. The leveling shelf is connected to the wall mount with screws that are screwed into and through the screw holes of the leveling shelf and then into the screw holes of the wall mount.

Other objects and advantages of the present invention will become apparent from the following descriptions, taken in connection with the accompanying drawings, wherein, by way of illustration and example, various embodiments of the present invention are disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION

Figure 1:
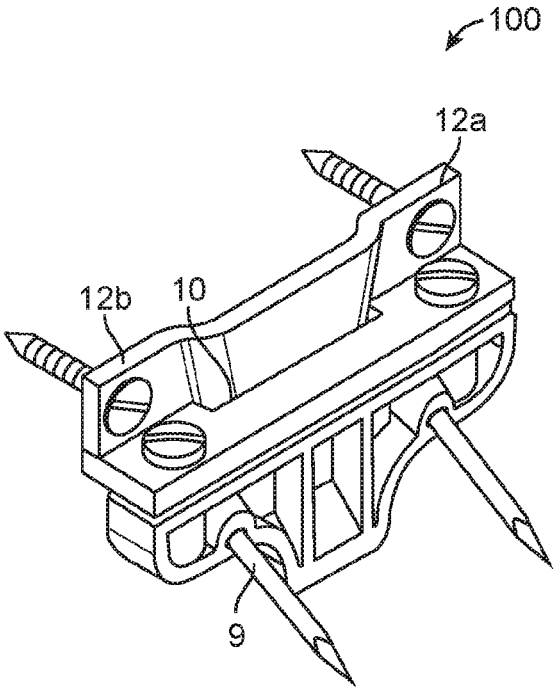
FIG. 1 is a perspective view of a picture frame hanging assembly in accordance with one embodiment.
Figure 2:
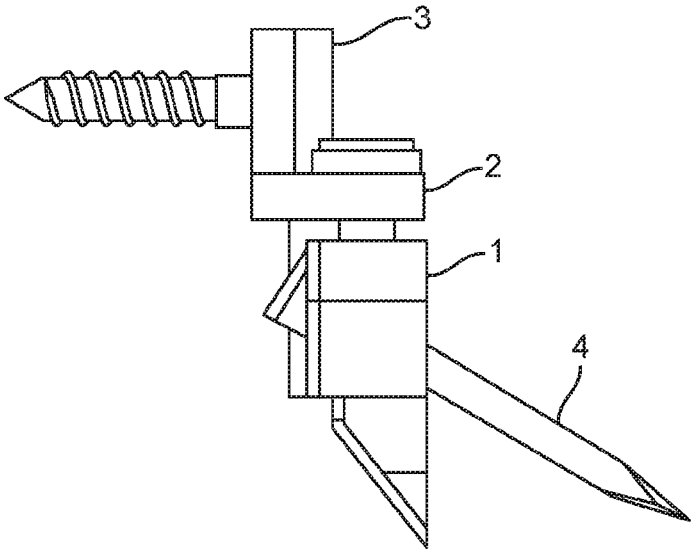
FIG. 2 is a side view of the picture frame hanging assembly depicted in FIG. 1.
Figure 3:
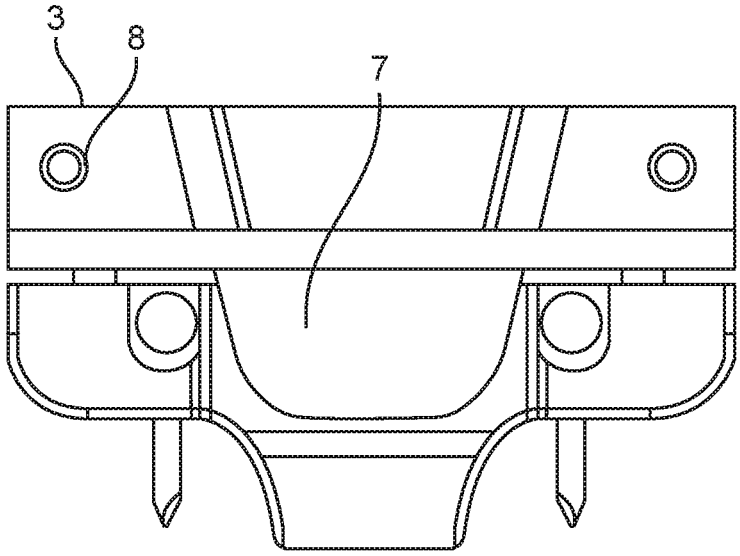
FIG. 3 is a front view of the picture frame hanging assembly depicted in FIG. 1.
Figure 4:
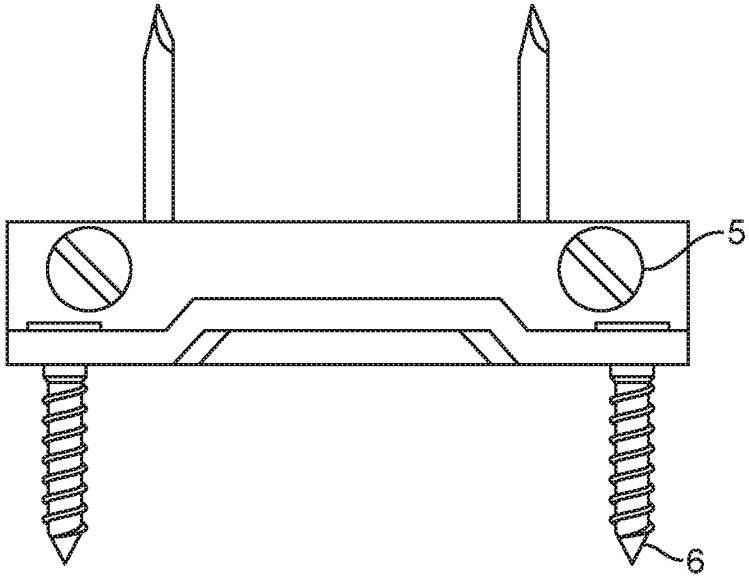
FIG. 4 is a top view of the picture frame hanging assembly depicted in FIG. 1.

Exemplary embodiments of the invention are shown in the accompanying figures. FIGS. 1-4 depict one embodiment of a picture frame hanging assembly 100. The picture frame hanging assembly 100 has three main components held together by various screws, bolts and locking washers as further described herein. The first component is a frame plate 3 that is attached to a picture frame through screws 6. The frame plate 3 has a tab 7 that extends downward and can be tapered as shown in FIG. 3. The frame plate 3 also has two screw holes 8 through which screws 6 are inserted for screwing into a picture frame. Each of the two screw holes 8 is formed into a side mounting arm 12*a* and 12*b* of the frame plate 3. Side mounting arms 12*a* and 12*b* extend outwardly on opposite sides of frame plate 3. Tab 7 can be offset from the side mounting arms 12*a* and 12*b* as shown in FIGS. 1 and 4.

Figure 5:
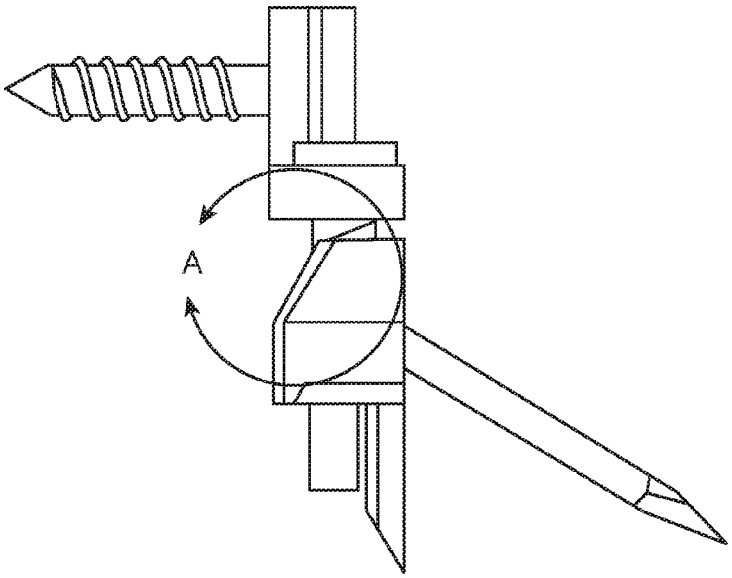
FIG. 5 is a side view of another embodiment of the frame hanging assembly in which the sides are sloped.
Figure 5A:
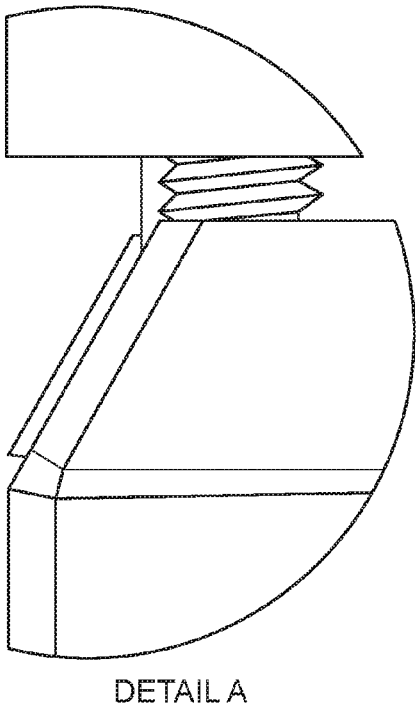
FIG. 5*a* is a detail of the section A of FIG. 5.

The second component is wall mount 1. Wall mount 1 is mounted onto a wall with nails 4 that are inserted through holes 9 in the wall mount 1. The top surface of wall mount 1 forms a shelf which has screw holes for receiving screws that can be screwed into the screw holes. As shown in a particular embodiment in FIGS. 5 and 5*a*, wall mount 1 can have a right side portion and a left side portion wherein each of those portions is sloped to receive a nails 4 at an angle. Each of right side portion and left side portion has nail holes, and each of those nail holes can be sloped downward at an angle so that the nails they receive are nailed into a wall at an angle rather than perpendicular to the wall.

The third component is a leveling shelf 2. Leveling shelf 2 is connected to the wall mount 1 through screws 5. Leveling shelf 2 has screw holes through which screws 5 are inserted. On the bottom surface concentric with the screw holes of leveling shelf 2 can be lock washers through which the screws 5 are screwed so that the lock washers each lock in tightly against the bottom surface of leveling shelf 2 when screws 5 are inserted through the screw holes and screwed into and through the lock washers. The lock washers can then bear some of the load of leveling shelf 2. Leveling shelf 2 has a slot 10 in between the two screw holes, with the two screw holes being on opposite sides of the slot 10 at a distance from one another.

Leveling shelf 2 is connected to wall mount 1 through screws 5. Screws 5 are screwed into the screw holes on the shelf of the wall mount 1, and this is the manner in which the wall mount 1 is connected to the leveling shelf 2.

Frame plate 3 is connected to the other two components (leveling plate 2 and wall mount 1) by inserting tab 7 of frame plate 3 through slot 10 of leveling shelf 2. Side mounting arms 12*a* and 12*b* come to rest atop leveling shelf 2.

Picture frame hanging assembly 100 can be used to level a picture frame and keep it plum with a wall by employing the following steps. Leveling shelf 2 is connected to wall mount 1 with screws 5. Then wall mount 1 is nailed against a wall with nails 4. Frame plate 3 is screwed into a picture frame with screws 6. Then tab 7 is inserted into slot 10 until side mounting arms 12*a* and 12*b* come to rest atop the top side of leveling shelf 2. Then the picture frame can be made level by adjusting the height of each side of leveling shelf 2 with screws 5. For example, tightening the right screw 5 will lower the right side of leveling shelf 2 and bring it closer to the top of wall mount 1. Loosening screw 5 on the left side of leveling shelf 2 raises the left side of leveling shelf 2 and moves it farther away from the top of wall mount 1. The opposite can be achieved by loosening screw 5 on the right side of leveling shelf 2, which raises the right side of leveling shelf 2, while tightening screw 5 on the left side, which lowers the left side of leveling shelf 2. Screws 5 are therefore very important to the leveling mechanism of the present invention. Screws 5 enable one end of leveling shelf 2 to move up and down independent of the other end thus allowing the leveling shelf 2 to be leveled. In this manner, the picture frame hanging assembly 100 can be used to level a picture frame that is attached to it.

Figure 6:
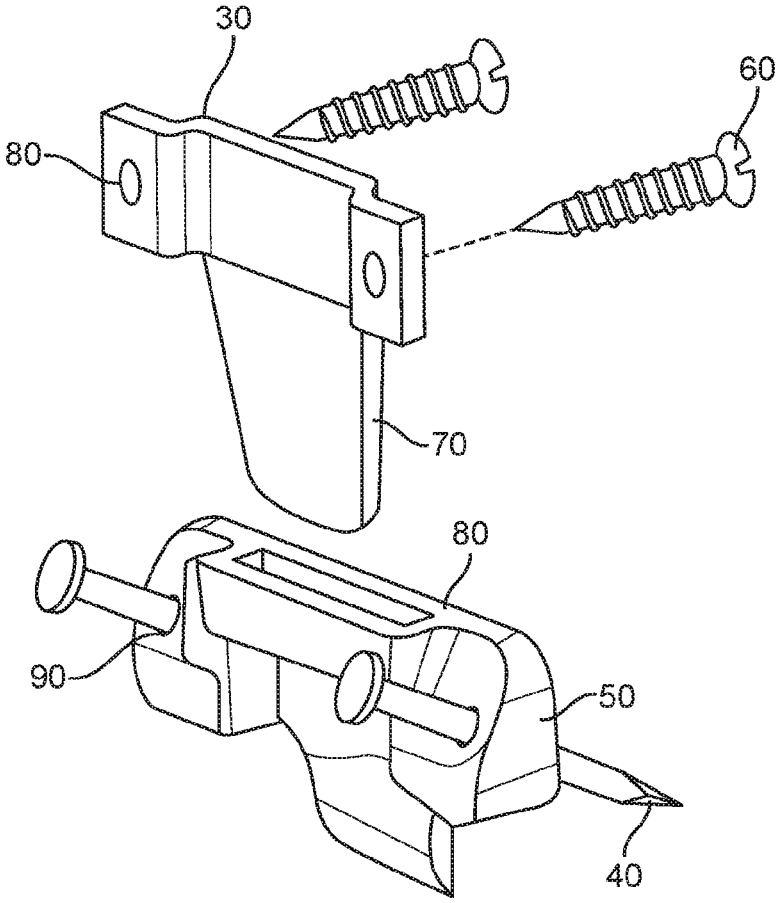
FIG. 6 is an exploded perspective view of a picture frame hanging assembly in accordance with another embodiment.
Figure 7:
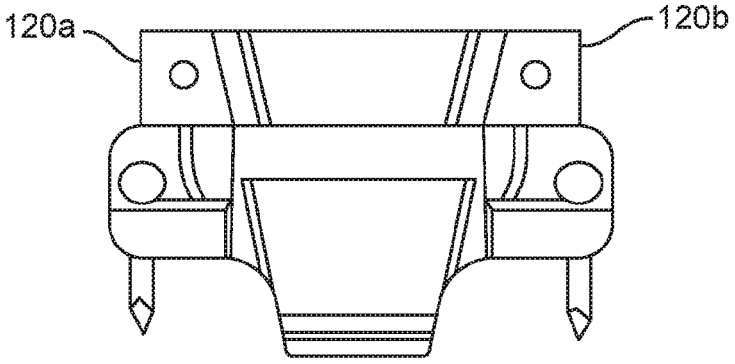
FIG. 7 is a front view of the picture frame hanging assembly depicted in FIG. 6.
Figure 8:
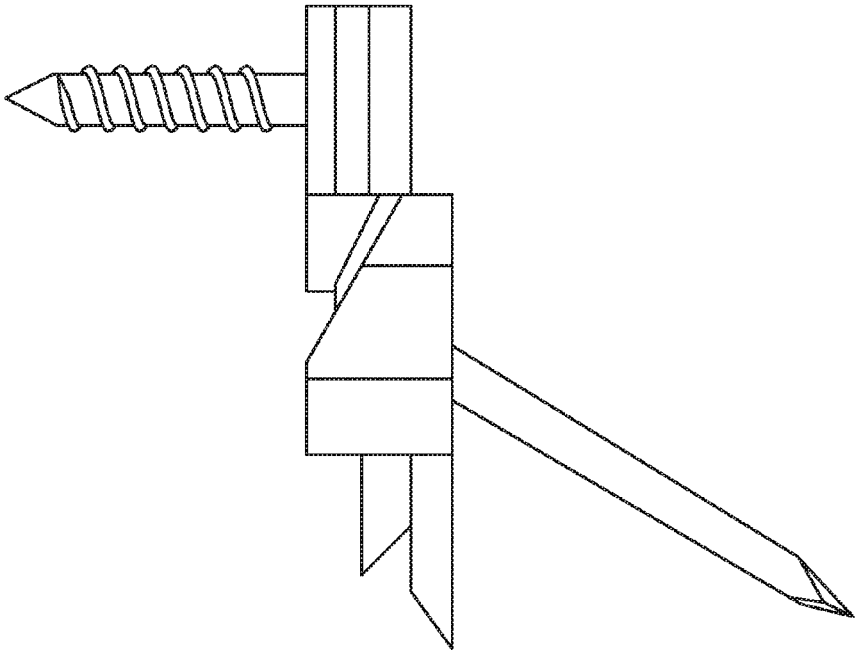
FIG. 8 is a side view of the picture frame hanging assembly depicted in FIG. 6.
Figure 9:
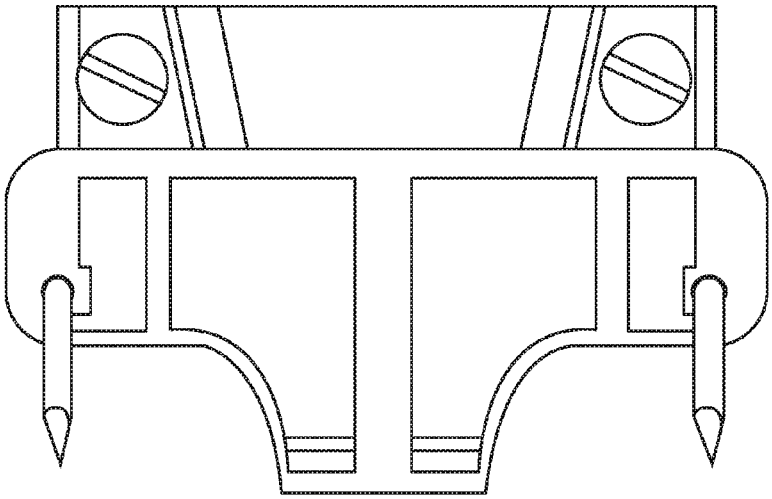
FIG. 9 is a front view of the picture frame hanging assembly depicted in FIG. 6.
Figure 10:
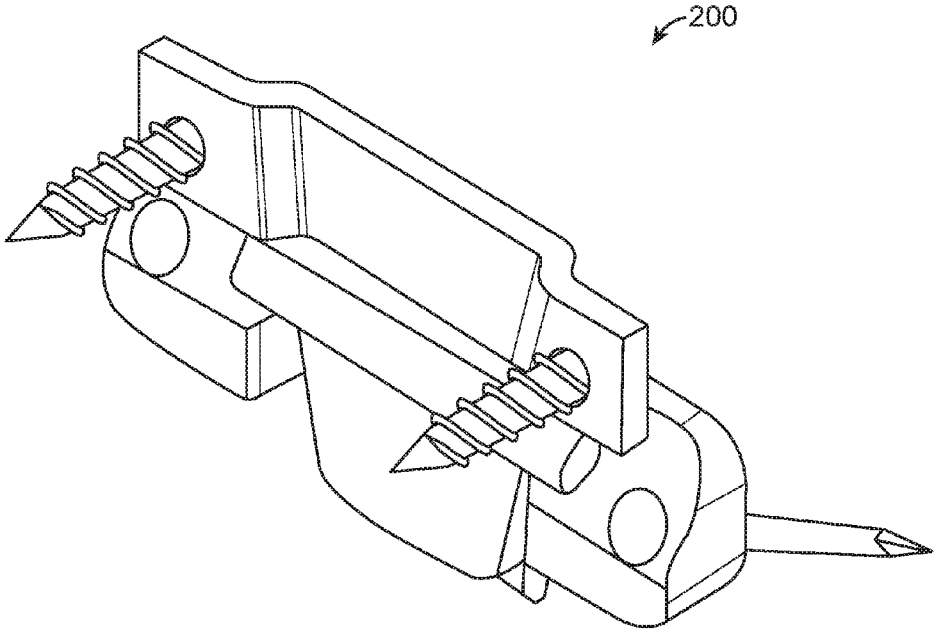
FIG. 10 is a perspective view of the picture frame hanging assembly depicted in FIG. 6.
Figure 11:
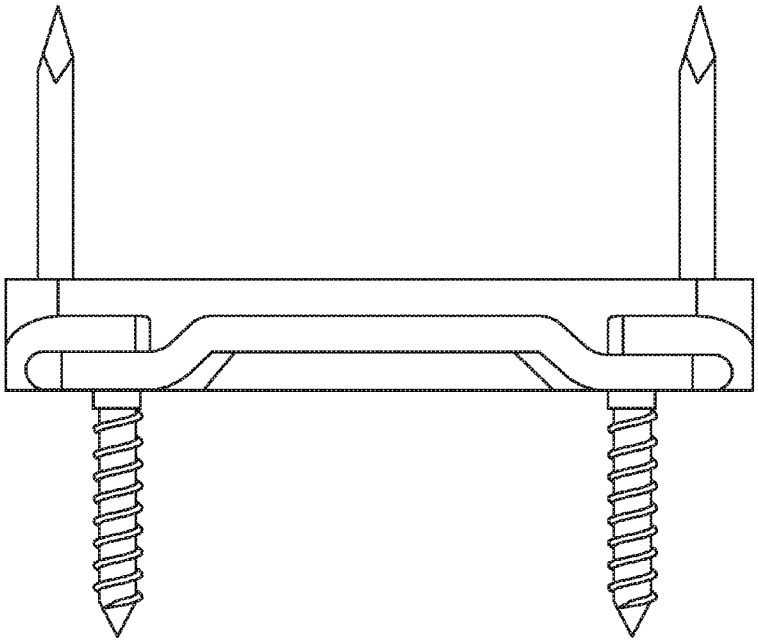
FIG. 11 is a top view of the picture frame hanging assembly depicted in FIG. 5.

FIGS. 6-11 show another embodiment of a picture frame hanging assembly 200. Picture frame hanging assembly 200 is similar to picture frame hanging assembly 100, except that it doesn't have a leveling shelf 2, and is made of two main components rather than 3. The first component is a frame plate 30 that is attached to a picture frame through screws 60. The frame plate 30 has a tab 70 that extends downward and can be tapered as shown in FIGS. 6, 7 and 10. The frame plate 30 also has two screw holes 80 through which screws 60 are inserted for screwing into a picture frame. Each of the two screw holes 80 is formed into a side mounting arm 120*a* and 120*b* of the frame plate 30. Side mounting arms 120*a* and 120*b* extend outwardly on opposite sides of frame plate 30. Tab 70 can be offset from the side mounting arms 120*a* and 120*b* as shown in FIGS. 6, 10 and 11.

The second component is wall mount 50. Wall mount 50 is mounted onto a wall with nails 40 that are inserted through holes 90 in the wall mount 50. As shown in a particular embodiment in FIGS. 6, 8 and 10, wall mount 1 can have a right side portion and a left side portion wherein each of those portions is sloped to receive nails 40 at an angle. Each of right side portion and left side portion has nail holes, and each of those nail holes can be sloped downward at an angle so that the nails 40 they receive are nailed into a wall at an angle rather than perpendicular to the wall. Wall mount 50 also has a horizontal slot 80 along its length that receives tab 70 of frame plate 30.

Picture frame hanging assembly 200 can be used to hang a picture frame and keep it flush against a wall by employing the following steps. Wall mount 150 is nailed against a wall with nails 40. Frame plate 30 is screwed into a picture frame with screws 60. Then tab 70 is inserted into slot 80 until side mounting arms 120*a* and 120*b* come to rest atop the walls around slot 80 as shown in FIG. 7-10. In this manner, the picture frame hanging assembly 200 can be used to hang a picture frame such that it is flush against a wall.

While the invention is susceptible to various modifications and alternative forms, specific examples thereof have been shown by way of example in the drawings and are herein described in detail. It should be understood, however, that the invention is not to be limited to the particular forms or methods disclosed, but to the contrary, the invention is to cover all modifications, equivalents, and alternatives falling within the spirit and scope of the appended claims.

I claim:

1. A picture frame hanging assembly comprising:

a frame plate comprising a tab extending downward from the frame plate and further comprising two or more screw holes for screwing the frame plate to a picture frame;

a wall mount wherein a top of the wall mount forms a shelf that comprises two screw holes on opposite sides of the shelf, the screw holes being a distance from one another; and a leveling shelf comprising a slot and two screw holes that are on opposite sides of the slot, the two screw holes of the leveling shelf being at the distance from one another;

wherein when assembled the tab of the frame plate is inserted into the slot of the leveling shelf and rests atop the leveling shelf and the leveling shelf is connected to the wall mount with two screws that are screwed into and through said two screw holes of the leveling shelf and then into said two screw holes of the wall mount.

2. The picture frame hanging assembly of claim 1, wherein the picture frame is leveled by adjusting the two screws such that one side of the leveling shelf is at a different distance from the shelf of the wall mount than an opposite side of the leveling shelf.

3. The picture frame hanging assembly of claim 1, wherein the wall mount further comprises two or more nail holes.

4. The picture frame hanging assembly of claim 1, wherein each of the screw holes of the frame plate is formed into a side mounting arm such that there are two side mounting arms on opposite sides of the frame plate.

5. The picture frame hanging assembly of claim 4, wherein the side mounting arms rest atop of the leveling shelf when the tab of the frame plate is inserted into the slot of the leveling shelf.

6. The picture frame hanging assembly of claim 5, wherein the tab is offset from the side mounting arms.

7. The picture frame hanging assembly of claim 3, wherein the wall mount has a right side portion and a left side portion each of which are sloped.

8. The picture frame hanging assembly of claim 7, wherein each of the right side portion and the left side portion has a nail hole, and each of the hail holes are sloped downward.

* * * * *